US010193276B1

(12) United States Patent
Lanzotti et al.

(10) Patent No.: US 10,193,276 B1
(45) Date of Patent: Jan. 29, 2019

(54) CONNECTOR HOUSING ASSEMBLY WITH COUPLING STRUCTURES

(71) Applicant: Sumitomo Wiring Systems, Ltd., Yokkaichi-shi, Mie (JP)

(72) Inventors: Joseph Lanzotti, Gross Pointe, MI (US); Jin Ahn, Farmington Hills, MI (US)

(73) Assignee: Sumitomo Wiring Systems, Ltd., Yokkaichi, Mie (JP)

( * ) Notice: Subject to any disclaimer, the term of this patent is extended or adjusted under 35 U.S.C. 154(b) by 0 days.

(21) Appl. No.: 15/962,005

(22) Filed: Apr. 25, 2018

(51) Int. Cl.
*H01R 13/40* (2006.01)
*H01R 13/631* (2006.01)
*H01R 13/436* (2006.01)
*H01R 13/64* (2006.01)

(52) U.S. Cl.
CPC ..... *H01R 13/6315* (2013.01); *H01R 13/4368* (2013.01); *H01R 13/64* (2013.01); *H01R 2201/26* (2013.01)

(58) Field of Classification Search
CPC ..... H01R 13/4362; H01R 13/4223; H01R 13/6215; H01R 13/621
USPC ..... 439/752.5, 595, 362–364, 594, 598, 733
See application file for complete search history.

(56) References Cited

U.S. PATENT DOCUMENTS 4,917,661 A 4/1990 Tirp et al.
6,435,921 B2 * 8/2002 Kojima ..... H01R 13/4362 439/399
6,524,135 B1 * 2/2003 Feldman ..... H01R 9/035 439/607.46
6,527,583 B2 * 3/2003 Plate ..... H01R 13/4362 439/157
6,575,788 B2 * 6/2003 Nimura ..... H01R 13/4223 439/595
6,595,807 B2 * 7/2003 Kashiyama ..... H01R 13/4362 439/752
6,659,797 B2 * 12/2003 Ichio ..... H01R 13/4361 439/595
6,682,367 B2 * 1/2004 Suzuki ..... H01R 13/4362 439/595
7,001,224 B2 2/2006 Sakurai et al.
8,231,409 B2 7/2012 Lebrun et al.

* cited by examiner

*Primary Examiner* — Phuong Chi T Nguyen
(74) *Attorney, Agent, or Firm* — Honigman Miller Schwartz and Cohn LLP

(57) ABSTRACT

A connector housing assembly configured to ensure proper coupling of components to align terminal cavities and terminal slots, lowering the chances that terminal cavities and terminal cavities obstruct, or possibly bend, terminal blades from a male connector is provided. The connector housing assembly includes a connector housing, a terminal position assurance (TPA), and a male blade stabilizer (MBS). The connector housing, includes a plurality of terminal cavities. The TPA and MBS include a plurality of terminal slots. The TPA includes walls that are slidingly received by an aperture in the MBS. The walls and aperture are configured to ensure that the MBA is coupled with the proper TPA and in a proper orientation. When the components of the connector housing assembly are properly coupled, the terminal cavities of the connector housing and the terminal slots of the TPA and the MBS align allowing a terminal to be seated there within.

16 Claims, 5 Drawing Sheets

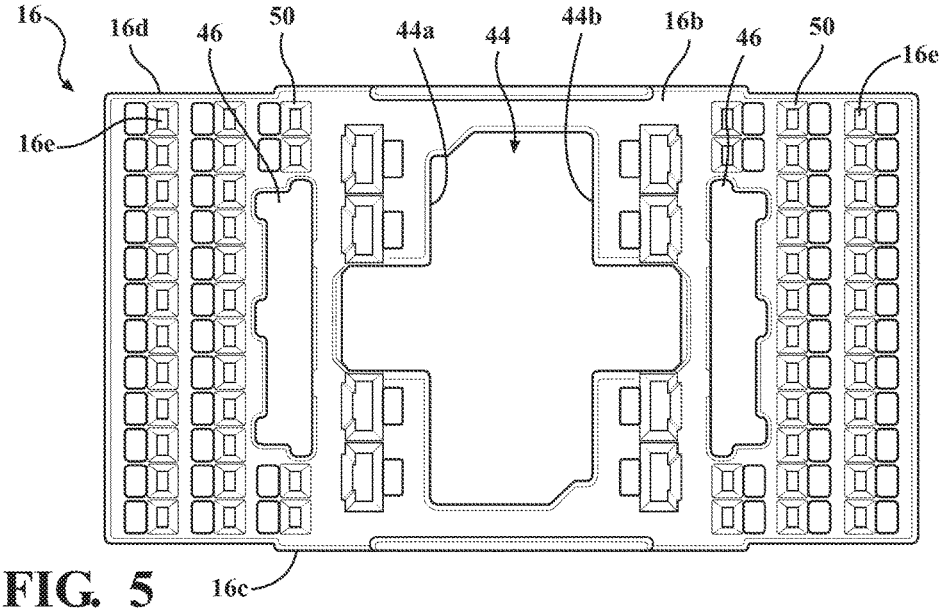
FIG. 5
FIG. 6
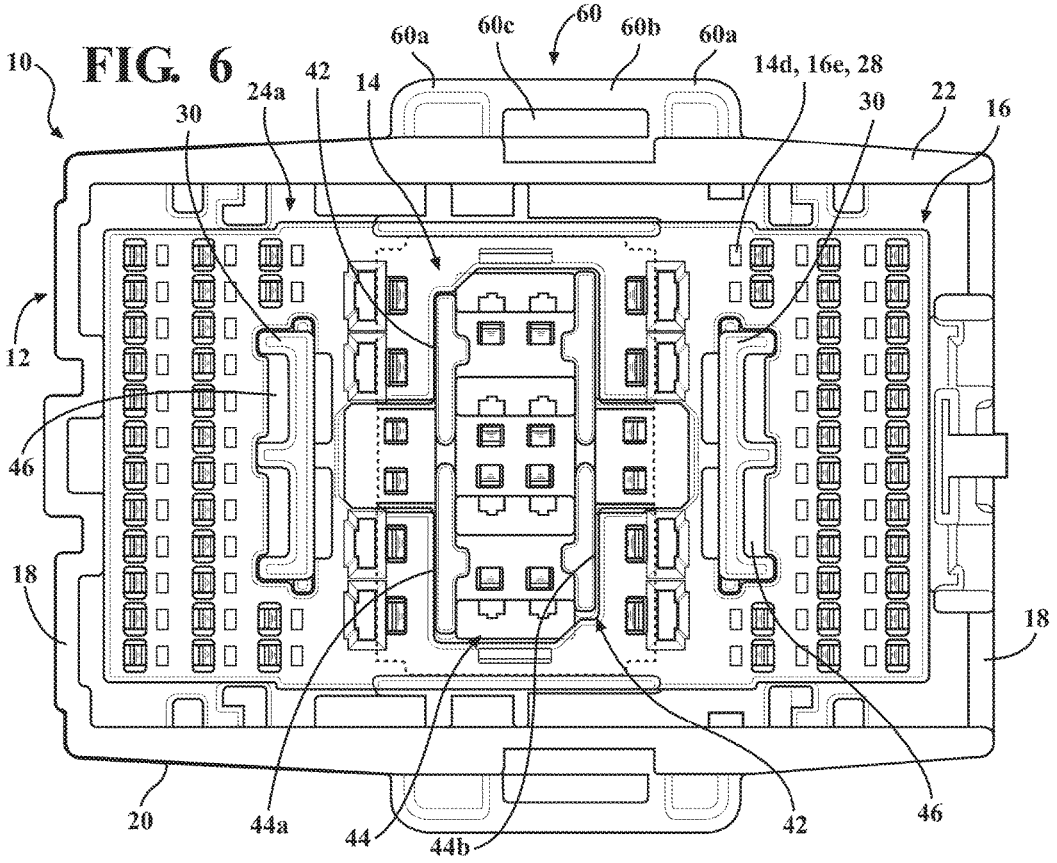

CONNECTOR HOUSING ASSEMBLY WITH COUPLING STRUCTURES

TECHNICAL FIELD

The present specification generally relates to a connector housing assembly configured to house a female connector and more specifically to a connector housing assembly with coupling structures to ensure components are assembled in a specific orientation.

BACKGROUND OF THE INVENTION

A connector housing assembly may include components such as a connector housing, a male blade stabilizer ("MBS"), and a terminal position assurance ("TPA"). The MBS and TPA are used to properly align the terminal blades of a male connector when coupled with a female connector. The connector housing assembly may include two types of TPA, a side TPA and a center TPA that mates with the MBS.

The connector housing includes terminal cavities and the TPAs and MBS include terminal slots. The terminal cavities of the connector housing align with the terminal slots of the TPAs and MBS when the components are properly aligned allowing terminals from a male connector to pass through the connector housing, TPAs, and MBS.

The connector housing assembly may be manufactured for multiple applications. That is, the same connector housing may be used for different vehicles. In such cases, the electrical connectors may be configured to have the same dimension, but different number of terminal cavities and/or the terminal cavities may be arranged differently so as to accommodate a specific vehicle. Accordingly, the installers must be careful to use the proper components. For example a center TPA for one application may not have the same number or arrangement of terminal cavities as an MBS used for a different application, and would therefore not be suitable for use with that MBS.

Connector housings include a wall having an inner surface defining a space for holding an electrical connector. The inner surface of the wall includes elongated ribs for guiding corresponding ribs disposed on the outer surface of the electrical connector. However, the ribs are configured to engage each other along a single plane and thus may separate from each other. Movement of the electrical connector can result in misalignment of the terminal cavities and terminal slots, obstructed or bending terminal blades from a male connector.

Accordingly, it remains desirable to have a connector housing assembly configured to prevent misalignment of the terminal cavities and terminal slots by ensuring components of the connector housing assembly are properly coupled. It is further desirable to have a connector housing assembly that prevents movement of the electrical connector with respect to the connector housing so as to prevent misalignment of the terminal cavities and terminal slots.

SUMMARY OF THE INVENTION

A connector housing assembly configured to prevent terminal cavities and terminal cavities from being misaligned, or possibly bending the terminal blades from a male connector by ensuring that the center TPA can only mate with a specific MBS in a specific orientation is provided. The connector housing assembly is further configured to prevent an electrical connector from moving within a connector housing. Accordingly, the connector housing assembly helps ensure that a proper electrical connection is achieved.

The connector housing assembly includes a connector housing, a center TPA, and an MBS. The connector housing, includes a plurality of terminal cavities. The center TPA and MBS include a plurality of terminal slots. The center TPA includes walls that are slidingly received by an aperture in the MBS. The walls and aperture are configured to allow the MBS to be coupled only to a specific center TPA when in a specific orientation. When the components of the connector housing assembly are properly coupled in a specific orientation, the terminal cavities of the connector housing and the terminal slots of the center TPA and the MBS align, allowing a terminal to be seated there within.

In one embodiment, the interior of the connector housing includes a plurality of protrusions on a bottom wall. The MBS includes a plurality of depressions on the bottom surface. Each of the protrusions encompasses a terminal cavity, and each depression encompasses a terminal slot. The protrusions are configured to be seated within the depressions of the MBS when the connector housing and MBS are properly aligned ensuring proper alignment of the terminal cavities and the terminal slots.

The connector housing assembly may be further configured to prevent movement of an electrical connector within the connector housing. In one embodiment, the connector housing includes a guide beam and a guide rib spaced apart from the guide beam so as to define a slot. The electrical connector includes an elongated member configured to slidingly fit within the slot so as to be bound by at least two surfaces. The guide beam and the guide rib prevent the electrical connector from moving within the connector housing.

In one embodiment, the connector housing assembly may be further configured to help retain the connector housing in a predetermined shape. The connector housing further includes a bridge attached to the outside of the connector housing to increase rigidity of the walls of the connector housing. Greater rigidity prevents flexing of the walls of the connector housing.

Accordingly, the connector housing assembly has coupling structures to ensure all components are coupled in a specific proper orientation and that the connector does not disengage from the connector housing.

BRIEF DESCRIPTION OF THE DRAWINGS

The embodiments set forth in the drawings are illustrative and exemplary in nature and not intended to limit the subject matter defined by the claims. The following description of the illustrative embodiments can be understood when read in conjunction with the following drawings, where like structure is indicated with like reference numerals and in which:

FIG. 5 is a view of the bottom surface of the MBS from the connector housing assembly in FIG. 2;

FIG. 6 is a top down view of the assembled connector housing assembly;

DETAILED DESCRIPTION

A connector housing assembly having components including coupling structures that prevent misalignment of a plurality of terminal cavities and terminal slots is provided. The connector housing assembly includes a connector housing, a center TPA, and an MBS. A pair of walls is disposed on the top surface of the center TPA. The MBS includes a center aperture. The center aperture is configured to slidingly receive the walls only when the MBS is in a specific orientation with respect to the center TPA. For instance, when the MBS is installed in the incorrect orientation or the wrong MBS is being installed, the walls on the center TPA interfere with the aperture on the MBS, preventing coupling. Accordingly, the MBS and center TPA are configured to prevent an improper MBS from being used, or the proper MBS from being installed improperly.

The connector housing assembly may further a guide beam and a guide rib configured to prevent disengagement of an electrical connector from the connector housing. The guide beam is spaced apart from the guide rib so as to define a slot. The electrical connector has an elongated member that slides into the slot. The guide beam and guide rib each abut opposite sides of the elongated member, reducing movement of the electrical connector with respect to the connector so as to ensure a proper electrical connection is achieved.

Figure 1:
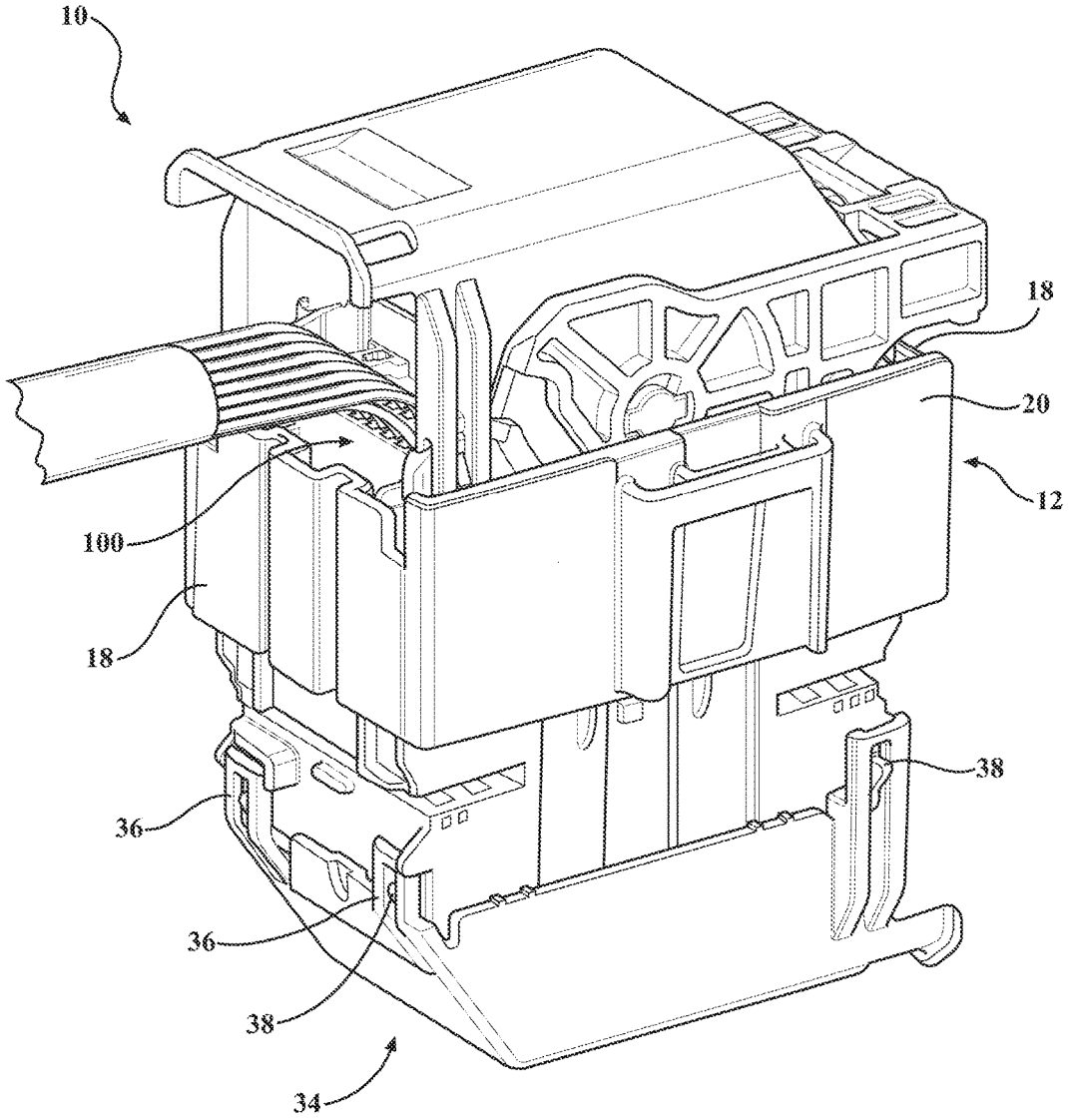
FIG. 1 is an assembled view of the connector housing assembly.

As used herein, the terms "top" and "bottom" refer to the disposition of the referenced part as depicted in FIG. 1. The term "back" refers to the side of the connector housing assembly 10 farthest from the viewer in FIG. 1 and the term "front" refers to the side of the connector housing opposite of the "back." The terms "inside" and "interior"" are used to refer the relative position or portion of a component that faces the center of the connector housing assembly. Similarly, the terms "outside" and "exterior" refer to the relative position or portion of the connector housing exposed to the environment.

Figure 2:
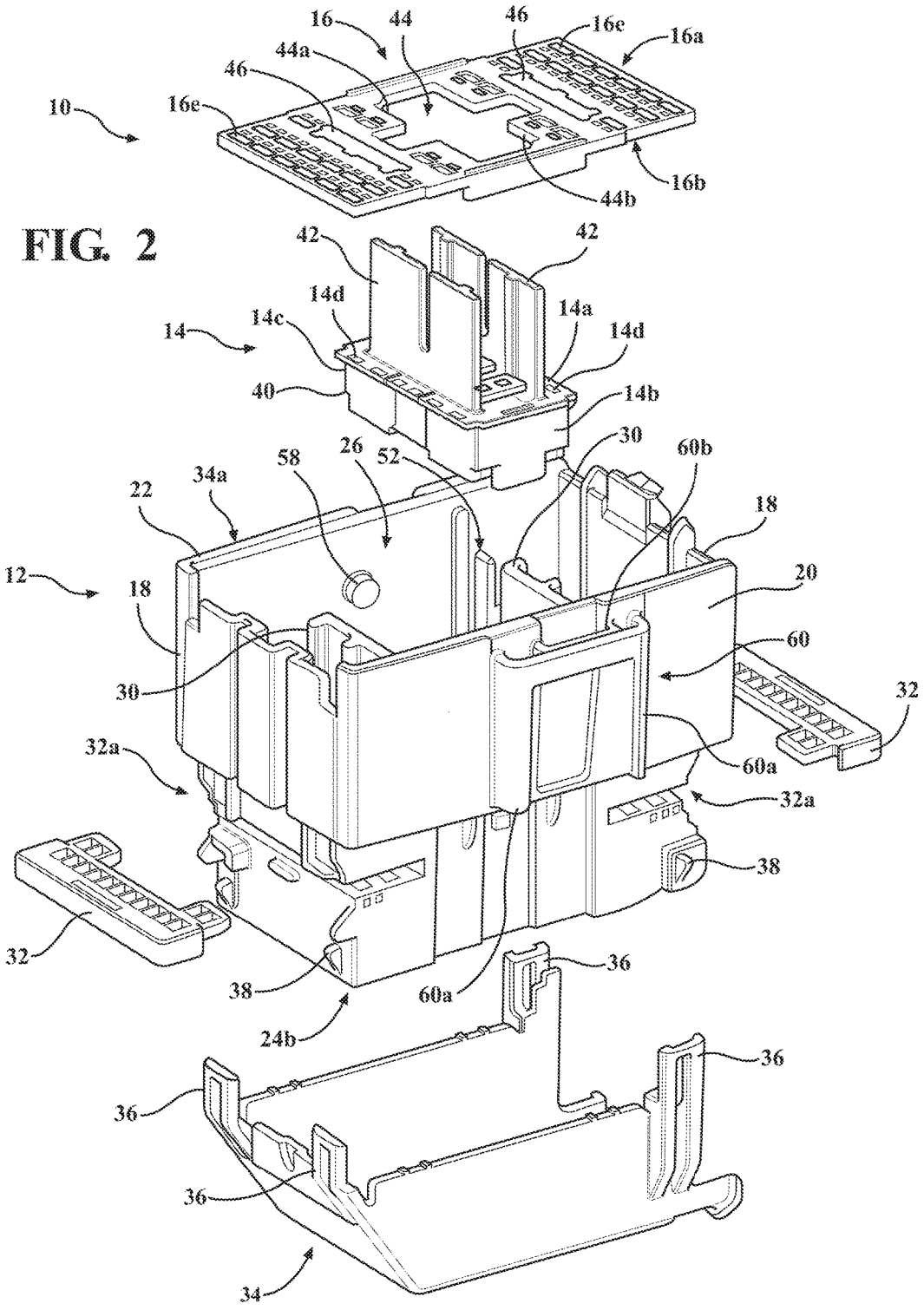
FIG. 2 is an exploded view of the a connector housing assembly.

With reference to FIGS. 1 and 2, a connector housing assembly 10 is provided. The connector housing assembly is configured to receive an electrical connector 100 so as to complete an electric connection. The connector housing assembly 10 includes a connector housing 12, a center TPA 14, and an MBS 16.

The connector housing 12 is illustratively shown as a generally cuboidal shape and includes a pair of sidewalls 18, a front wall 20, and a back wall 22 opposite the front wall 20. The connector housing further includes a bottom wall 24 having a top surface 24*a* and a bottom surface 24*b*. The top surface 24*a* of the bottom wall 24 closes the bottom of the connector housing 12 so as to form a connector cavity 26 having an open top 26*a*. The connector housing 12 further includes a plurality of terminal cavities 28 extending along a longitudinal axis corresponding to the height of the bottom wall 24 so as to be open at the top surface 24*a* and the bottom surface 24*b* of the bottom wall 24. The bottom wall 24 of the connector housing includes a plurality of locking tabs 24*c* on the bottom wall 24.

Figure 3:
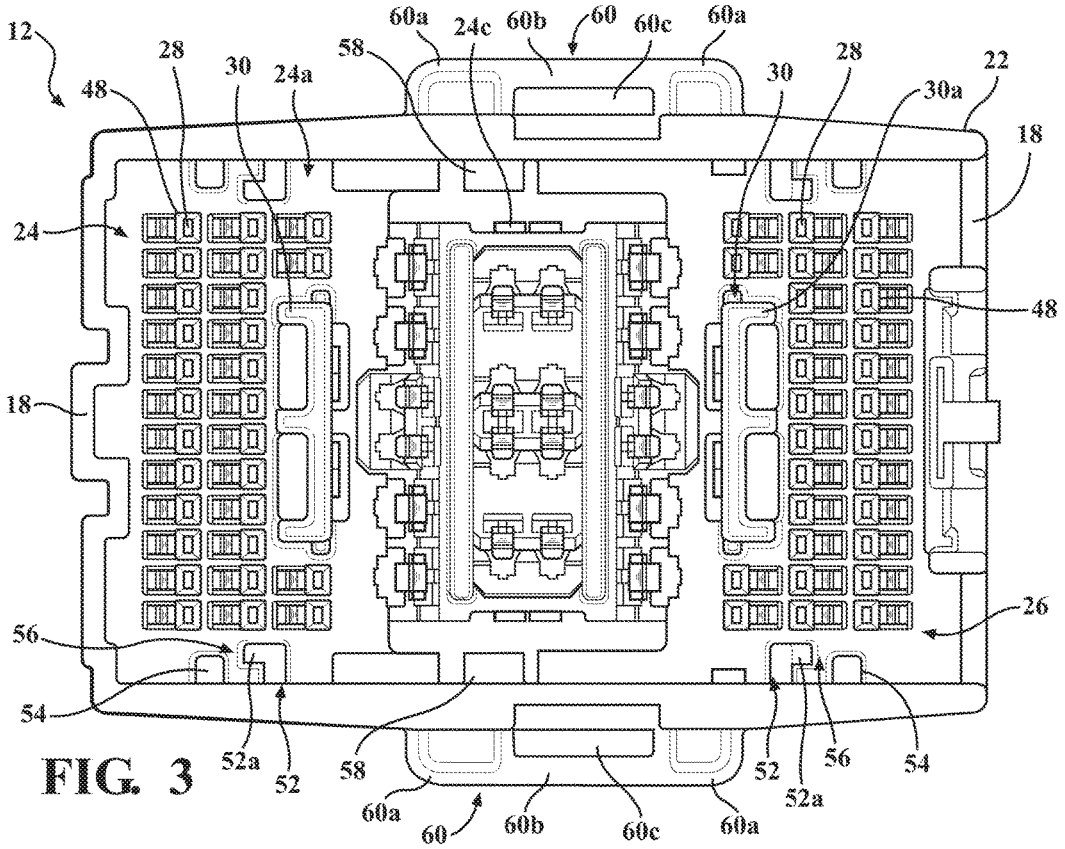
FIG. 3 is a top down view of the connector housing shown in FIG. 1.

The connector housing 12 further includes a pair of inner walls 30 disposed on the bottom wall 24 that guide the MBS into the connector cavity 26. The inner walls 30 are generally orthogonal to the bottom wall 24 and extend between the front wall 20 and back wall 22 of the connector housing 12. The inner walls 30 extend upwardly from the bottom wall 24 to a height less than that of the sidewalls 18 of the connector housing 12. The inner walls 30 include ribs 30*a* that extend towards one of the sidewalls 18 of the connector housing 12. In FIG. 3 the inner walls 30 are shown to have three ribs 30*a*, one on each of the inner walls 30 and one generally in the center of the inner wall 30.

The connector housing assembly 10 further includes a pair of side TPAs 32 and a bottom cover 34. Each of the side TPAs 32 slidingly engages a TPA slot 32*a* disposed in the side of the connector housing 12. The bottom cover 34 includes a plurality of locking clips 36 that are configured engage a plurality of locking nubs 38 on the outside of the connector housing 12. Engagement of the locking clips 36 with the locking nubs 38 secures the bottom cover 34 to the connector housing 12. The connector housing 12, center TPA 14, MBS 16, side TPAs 32, and bottom cover 34 may be formed of a durable material adaptable for use in an injection molding process, illustratively including polypropylene.

Figure 4A:
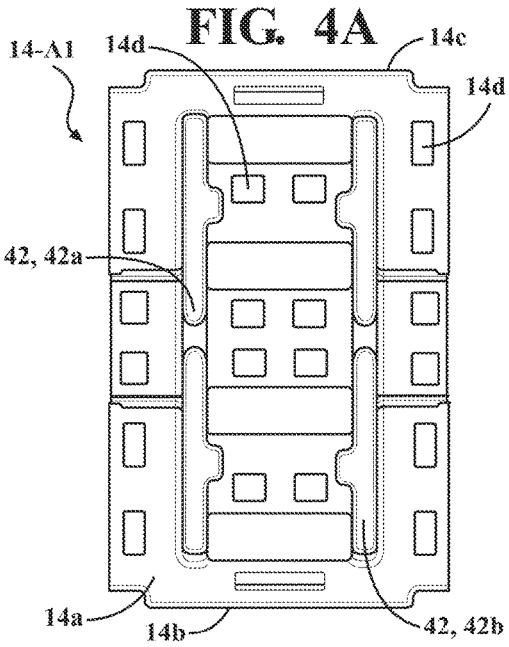
FIG. 4A is a top down view of a center TPA.
Figure 4B:
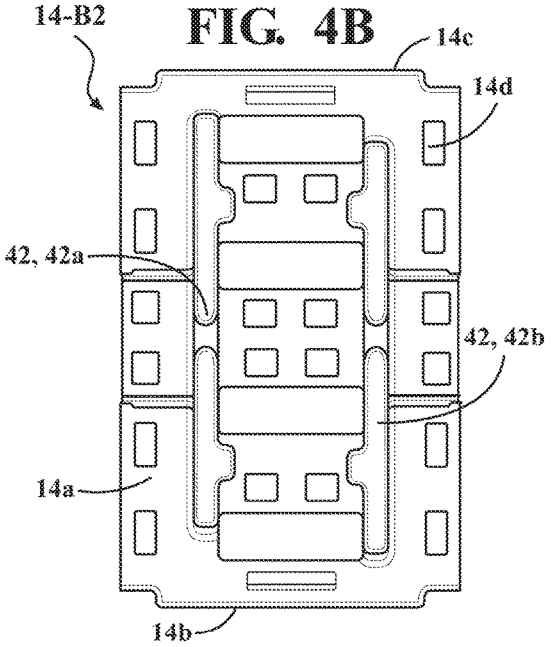
FIG. 4B is a top down view of the center TPA shown in FIG. 2.

With reference again to FIG. 2 and now also to FIGS. 4A and 4B, the connector housing 12 is configured to accommodate a center TPA 14. The center TPA 14 is configured to help stabilize terminal blades (not shown) so as to facilitate an electrical connection. The center TPA 14 includes a base 40 configured to engage the plurality of locking tabs 24*c* on the bottom wall 24 of the connector housing 12, securing the center TPA 14 to the connector housing 12. FIGS. 4A and 4B depict two center TPAs 14 distinguishable from each other structurally. Each center TPA 14 may be used in different electrical systems within an automobile. For example, the center TPA 14 in FIG. 4A could be used to form an electrical connection within the system controlling the power windows of the automobile while the center TPA 14 in FIG. 4B may be used in the electrical system for the windshield wipers.

The center TPA 14 includes a top surface 14*a*, a front edge 14*b*, and a back edge 14*c*. The top surface 14*a* of the center TPA 14 has a plurality of terminal slots 14*d*. The terminal slots 14*d* are positioned so as to align with corresponding terminal cavities 28 on the top surface 24*a* of the bottom wall 24 of the connector housing 12 when the center TPA 14 is secured to the connector housing 12. Alignment of the terminal slots 14*d* and the terminal cavities 28 allows a terminal blade to pass through the connector housing unobstructed and without bending.

The center TPA 14 further includes a pair of TPA walls 42 spaced apart from each other and disposed on the top surface 14*a*. The TPA walls 42 are generally orthogonal to the top surface 14*a* of the center TPA 14 and run longitudinally along the top surface 14*a* of the center TPA 14. The TPA walls 42 are generally centered on the top surface 14*a* of the center TPA 14. FIG. 4A depicts a center TPA 14 where the displacement of one TPA wall 42 from the front edge 14*b* and the back edge 14*c* is the same as the displacement of the other TPA wall 42 from the front edge 14*b* and the back edge 14*c* so as to be generally centered with respect to each other. FIG. 4B depicts a center TPA 14 having TPA walls 42 with the same length as the TPA walls 42 shown in FIG. 4A. The center TPA 14 shown in FIG. 4B differs from the center TPA 14 shown in FIG. 4A in that the TPA walls 42 are offset such that one TPA wall 42*a* is displaced farther from the front edge 14*b* than the other TPA wall 42*b*, such that TPA wall 42*b* is displaced farther from the back edge 14*c* than TPA wall 42*a*.

With reference again to FIG. 2 and now to FIG. 5, a view of the bottom surface 16*b* of the MBS 16 is provided. The MBS 16 is configured to be seated within the connector cavity 26 over the center TPA 14. The MBS 16 helps stabilize terminal blades (not shown) so as to facilitate an electrical connection. The MBS 16 is a generally planar member having a rectangular body. The MBS 16 includes a top surface 16*a* opposite of a bottom surface 16*b*, a front edge 16*c* and a back edge 16*d*. The MBS 16 includes a plurality of terminal slots 16*e* passing through the top surface 16*a* and the bottom surface 16*b*. The terminal slots 16*e* are positioned so as to align with a respective terminal cavity 28 on the connector housing 12 and the terminal slots 14*d* on the center TPA 14 when the MBS 16 is properly positioned within the connector cavity 26.

The MBS 16 includes an aperture 44 and openings 46. The aperture 44 and openings 46 pass through the top surface 16*a* and the bottom surface 16*b* of the MBS 16. The aperture 44 is generally located in the center of the MBS 16 and configured to receive the TPA walls 42 on the center TPA 14. One opening 46 is disposed on the MBS 16 between the aperture 44 and a side of the MBS 16 and the other opening 46 is disposed between the aperture 44 and the other side of the MBS 16. The openings 46 are generally elongated and dimensioned to slidingly receive the inner walls 30 of the bottom wall 24 so as to guide the MBS 16 into position to align the terminal slots 16*e* of the MBS 16 with the terminal slots 14*d* of the center TPA 14 and the terminal cavities 28.

The aperture 44 of the MBS 16 includes inner edges 44*a* and 44*b*. Inner edge 44*a* defines one side of the aperture 44 and inner edge 44*b* defines the other side of the aperture 44. The inner edges 44*a*, 44*b* of the aperture 44 extend along an axis. The inner edges 44*a*, 44*b* are configured to engage corresponding TPA walls 42 of center TPA 14. When mounting the MBS 16 onto the center TPA 14, the TPA walls 42 slide against the inner edges 44*a*, 44*b* of the aperture 44. The bottom surface 16*b* of the MBS 16 is seated onto the top surface 14*a* of the center TPA 14 and the inner edges 44*a*, 44*b* abut against corresponding TPA walls 42 of the center TPA 14 when the MBS 16 is fully mounted onto the center TPA 14. The inner edges 44*a*, 44*b* depicted in FIG. 5 have the same length but are offset such that inner edge 44*b* is displaced farther from the front edge 16*c* than inner edge 44*a* such that inner edge 44*a* is displaced farther from the back edge 16*d* than inner edge 44*b*. The displacement of the inner edges 44*a* defines corners 44*c* of the aperture 44. In one embodiment, the corners 44*c* are angled.

With reference again to FIG. 2 and now to FIG. 6, a top down view of the connector housing assembly 10 is provided. The center TPA 14 is inserted through the open top 26*a* of the connector cavity 26 and the base 40 engages the tabs 24*c* of the connector housing 12, securing the center TPA 14 within the connector cavity 26. When the center TPA 14 is secured within the connector cavity 26, the terminal slots 14*d* align with the terminal cavities 28.

The MBS 16 is secured within the connector cavity 26 and is mounted over the center TPA 14. The aperture 44 receives the TPA walls 42 of the center TPA 14 and the openings 46 receive the inner walls 30 of the bottom wall 24 of the connector housing 12. As the MBS 16 is inserted into the connector housing 12, the inner edges 44*a*, 44*b* of the aperture 44 slide along respective TPA walls 42 of the center TPA 14.

As the inner edges 44*a*, 44*b* are offset from each other, the MBS 16 is prevented from being coupled with the wrong center TPA 14. For instance, the MBS 16 shown in FIG. 5 can be coupled to a second center TPA 14-B2 in FIG. 4B but not a first center TPA 14-A1 in FIG. 4A. The first center TPA 14-A1 has TPA walls 42 that are generally centered. As such, the corners 44*c* of the aperture 44 will overlap with the TPA walls 42, and the interference between the corners 44*c* and TPA walls 42 will prevent the MBS 16 from coupling with the first center TPA 14-A1. On the other hand, the second center TPA 14-B2 has TPA walls 42*a*, 42*b*, with a length substantially the same as the inner edges 44*a*, 44*b* of the aperture 44 and are offset from one another in the same spatial dimension as the inner edges 44*a*, 44*b* are offset from each other. The offset positioning of the TPA walls 42 allows the TPA walls 42 to slide against the inner edges 44*a*, 44*b* without interference from the corner 44*c*, allowing the MBS 16 to be mounted over the second center TPA 14-B2.

Further, the offset inner edges 44*a*, 44*b* prevent the MBS 16 from being mounted over the second center TPA 14-B2 in the wrong orientation. For instance, the MBS 16 shown FIG. 5 cannot be mounted with the second center TPA 14-B2, when the MBS 16 is upside down relative to the orientation shown in FIG. 2. If the MBS 16 is inserted into the connector housing 12 with the top surface 16*a* facing the bottom wall 24 of the connector housing 12, a portion of the TPA walls 42 will overlap with corners 44*c*, and the interference between the corners 44*c* and TPA walls 42 will prevent the MBS 16 from being pushed down to the bottom wall 24. When the MBS 16 is inserted with the bottom surface 16*b* facing the bottom wall 24, the TPA walls 42 and the inner edges 44*a*, 44*b* are aligned allowing the MBS 16 to couple with the center TPA 14 and the connector housing 12. Accordingly, the center TPA 14 and MBS 16 are configured to ensure that the proper MBS 16 is coupled with the proper center TPA 14, and that the MBS 16 is mounted in the proper orientation.

When the proper MBS 16 has been coupled with the center TPA 14 in the proper orientation, the terminal slots 16*e* on the MBS 16 align with the terminal slots 14*d* on the center TPA 14 and the terminal cavities 28 of the connector housing 12. In this way, terminal blades (not shown) can be seated within the terminal cavities 28 and the terminal slots 14*d*, 16*e* to form an electrical connection with an electrical connector 100 shown in FIG. 8. The center TPA 14 and MBS 16 ensure the terminal blades are properly aligned with connector cavities 102 in the electrical connector 100 and prevent the terminal blades from being bent.

Figure 7:
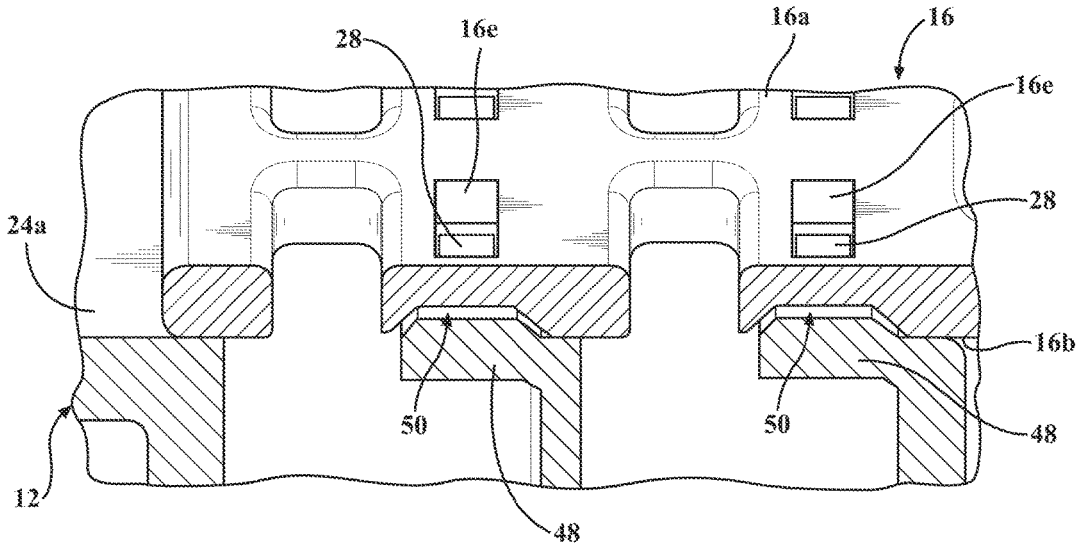
FIG. 7 is a cross-sectional view of the MBS and connector housing.

In one embodiment shown in FIG. 7, the top surface 24*a* of the bottom wall 24 of the connector housing 12 includes a plurality of protrusions 48. The bottom surface 16*b* of the MBS 16 includes a plurality of depressions 50 as shown in FIGS. 2 and 4. Each protrusion 48 bounds a respective terminal cavity 28. The depressions 50 are recessed portions of the bottom surface 16*b* of the MBS 16. Each depression 50 bounds a respective terminal slot 16*e*. The depressions 50 have a shape inverse that of the protrusions 48, allowing each depression 50 to receive a protrusions 48 when the MBS 16 is secured within the connector cavity 26. When the protrusions 48 are seated within the depressions 50, the MBS 16 is flush with the top surfaces 14*a*, 24*a* of the center TPA 14 and the bottom wall 24. If the MBS 16 is improperly inserted into the connector housing 12 with the top surface 16*a* facing the bottom wall 24, the top surface 16*a* will rest on the protrusions 48, preventing the MBS 16 from being fully inserted in the connector housing 12.

In one embodiment, the protrusions 48 are shaped generally like truncated pyramids and the depressions 50 have a corresponding inverse shape configured to receive the protrusions 48. Additionally, the depressions 50 prevent the MBS 16 from being inserted into an improper connector housing 12.

With reference again to FIGS. 2, and 6, the connector housing assembly 10 may be further configured to restricts side-to-side movement of the electrical connector 100 with respect to the connector housing 12 which may disrupt an electrical connection.

The connector housing 12 further includes a guide beam 52 and a guide rib 54. The guide beams 52 and guide ribs 54 are elongate members extending along the interior of the front wall 20 and the back wall 22 of the connector housing 12. The guide beams 52 have a cantilevered portion 52*a* spaced apart from the front wall 20 and back wall 22 of the connector housing 12 so as to give the guide beam 52 an L-shaped cross section when viewed from the top. The guide beam 52 and guide rib 54 are spaced apart from each other so as to form a slot 56.

Figure 8:
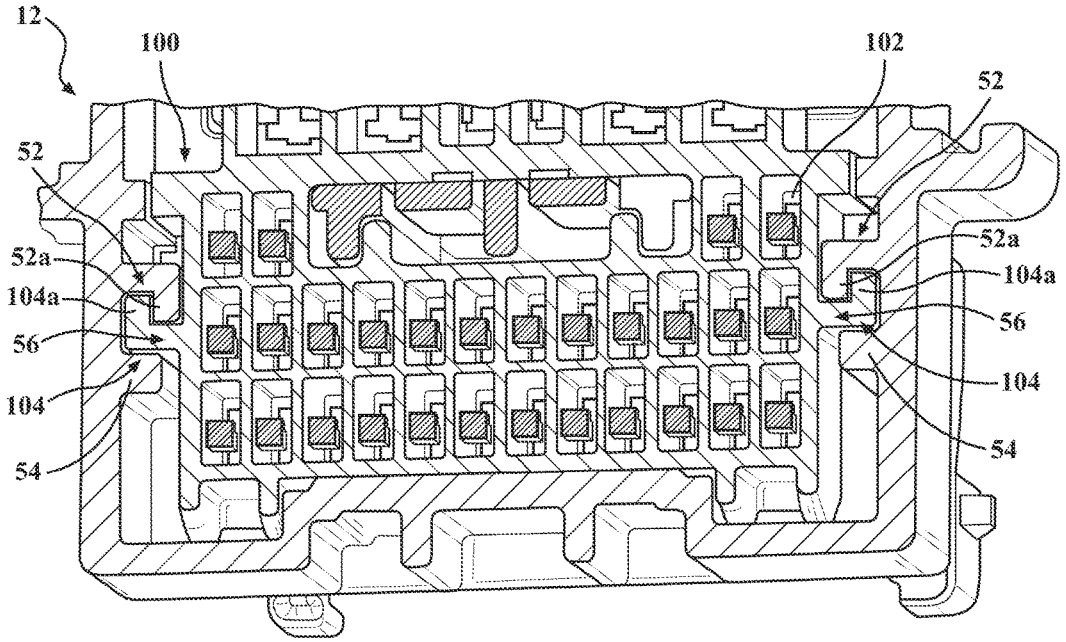
FIG. 8 is a cross-sectional view of a connector housed in the connector housing.

The electrical connector 100 includes elongated members 104. The elongated members 104 extend from the outer surface of the electrical connector 100. The elongated members 104 include a cantilevered portion 104*a* so as to give the elongated members 140 an L-shaped cross section when viewed from the top. The slot 56 is dimensioned so as to slidingly receive an elongated member 104 of the electrical connector 100. In FIG. 8, the slot 56 is illustratively shown to have an L-shaped cross section corresponding to the cross section of the elongated member 104.

When the electrical connector 100 is positioned within the connector housing 12 and the elongated member 104 slidingly engages the slot 56. The guide beam 52 abuts one side of the elongated member 104 and the guide rib 54 abuts the other side of the elongated member 104. The cantilevered portion 52*a* of the guide beam 52 contacts a corresponding cantilevered portion 104*a* of the elongated member 104. The position of the elongated member 104 between the guide beam 52 and the guide rib 54 restricts the side-to-side movement of the electrical connector 100 with respect to the connector housing 12 which may disrupt an electrical connection.

In one embodiment, the connector housing assembly 10 is configured to prevent disengagement of the electrical connector 100 from the connector housing 12 resulting from bending or flexing of the front wall 20 or the back wall 22. The connector housing 12 may further include a pair of nubs 58 and a bridge 60. The pair of nubs 58 extend from the front wall 20 and the back wall 22 of the connector housing 12 into the connector cavity 26. The nubs 58 are configured to be seated within a corresponding depression on the outer surface of the electrical connector 100 when the connector is inserted into the connector housing 12.

The bridges 60 disposed on the connector housing 12 include bridge supports 60*a* and a connecting piece 60*b*. The bridge supports 60*a* are spaced apart from each other and disposed on the outer surface of the front wall 20 and back wall 22 of the connector housing 12. The bridge supports 60*a* are elongated members that extend from the top of the connector housing 12 towards the bottom of the connector housing 12, where the top of the bridge supports 60*a* are generally square in shape. The connecting pieces 60*b* span the distance between the bridge supports 60*a* connecting the bridge supports 60*a* to each other. The connecting pieces 60*b* create gaps 60*c* defined by the exterior of the connector housing 12, the interior side of the connecting piece 60*b*, and the two bridge supports 60*a*.

Bending of the front wall 20 or back wall 22 may cause the he nubs 58 to disengage the depression in the electrical connector 100 leading to disengagement of the electrical connector 100 from the connector housing 12. The bridges 60 provide rigidity to the front wall 20 and the back wall 22, making it less likely the front wall 20 or the back wall 22 will bend. As such, the bridges 50 make it less likely that the nubs 48 will disengage the depression on the electrical connector 100 caused by bending of the front wall 20 or the back wall 22.

Accordingly, provided herein is a connector housing assembly 10 that ensures proper coupling of a connector housing 12, a center TPA 14, and an MBS 16. Proper coupling of the connector housing 12, center TPA 14, and MBS 16 will ensure alignment of the terminal cavities 28 and terminal slots 14*d*, 16*e*. The MBS 16 includes an aperture 44 configured to receive TPA walls 42 on the center TPA 14. The TPA walls 42 and aperture 44 are configured to prevent the MBS 16 from being coupled with the wrong center TPA 14. The center TPA walls 14 and aperture 44 also prevent the MBS 16 from being coupled with the center TPA 14 in the wrong orientation. The MBS 16 may also include depressions 50 configured to receive protrusions 48 disposed on the bottom wall 24 of the connector housing 12 when the MBS 16 is in the proper orientation.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A connector housing assembly configured to house an electrical connector, the connector housing assembly comprising:

a connector housing having a pair of side walls, a front wall, a back wall, and a bottom wall defining a connector cavity configured to receive an electric connector and having a plurality of terminal cavities;

a terminal position assurance having a top surface, a bottom surface, a plurality of first terminal slots, and a pair of walls, the terminal position assurance configured to be seated in the connector cavity;

a male blade stabilizer having a top surface, a bottom surface, a plurality of second terminal slots, and an aperture having a pair of inner edges defining sides of the aperture, wherein each of the pair of inner edges is offset from the other, the male blade stabilizer is configured to be seated in the connector cavity over the terminal position assurance, wherein a width of each of the pair of walls of the terminal position assurance is the same length as a corresponding one of the pair of inner edges of the aperture and abuts the corresponding inner edges of the aperture when the male blade stabilizer is seated over the terminal position assurance.

2. The connector housing assembly as set forth in claim 1 wherein the aperture is further defined by a pair of corners which are configured to interfere with the walls of the terminal position assurance when the male blade stabilizer is installed incorrectly.

3. The connector housing assembly as set forth in claim 1, wherein the connector housing further includes a plurality of protrusions on the bottom of the connector cavity and the male blade stabilizer including a plurality of depressions on the bottom surface, wherein each of the plurality of protrusions bounds a respective terminal cavity and each of the plurality of depressions bounds a respective terminal slot, and wherein the plurality of depressions are configured to receive the plurality of protrusions.

4. The connector housing assembly as set forth in claim 3, wherein each of the plurality of protrusions are shaped as a truncated pyramid and each of the plurality of depressions are a corresponding inverse truncated pyramid.

5. A connector housing assembly as set forth in claim 1, wherein the connector housing further includes a nub, a guide beam, and a guide rib, where the guide beam and the guide rib are spaced apart from each other so as to define a slot; and the electrical connector further including a depression and an elongated member, wherein the depression is configured to receive the nub and the elongated member slidingly engages the slot when the electrical connector is in the connector housing so as to retain the electrical connector in a predetermined position and secure an electrical connection.

6. The connector housing assembly as set forth in claim 5, wherein the connector housing includes four each of the guide beams and guide ribs and the electrical connector includes four corresponding elongated members.

7. The connector housing assembly as set forth in claim 6, the connector housing further including a bridge disposed on an outer surface of the front wall and the back wall that increases a rigidity of the front wall and the back wall.

8. The connector housing assembly as set forth in claim 7, wherein the front wall and the back wall each include an upper lip that increases in thickness as it approaches the bridge.

9. A connector housing assembly configured to house an electrical connector, the connector housing assembly comprising:

a connector housing having a pair of side walls, a front wall, a back wall, and a bottom wall defining a connector cavity configured to receive an electric connector and having a plurality of terminal cavities;

a first terminal position assurance having a top surface, a bottom surface, a plurality of first terminal slots, and a pair of first walls, the terminal position assurance configured to be seated in the connector cavity, wherein each of the pair of first walls is offset from the other;

a second terminal position assurance having a top surface, a bottom surface, a plurality of second terminal slots, and a pair of second walls, the terminal position assurance configured to be seated in the connector cavity, wherein the pair of second walls differ spatially from the pair of first walls;

a male blade stabilizer having a top surface, a bottom surface, a plurality of third terminal slots, and an aperture having a pair of inner edges defining sides of the aperture, wherein each of the pair of inner edges is offset from the other in the same spatial orientation as the pair of first walls, the male blade stabilizer is configured to be seated in the connector cavity over the first terminal position assurance, and the offset positioning of the inner edges results in interference between the inner edges and the second walls of the second terminal position assurance, accordingly, the male blade stabilizer can be seated in the connector cavity over the first terminal position assurance, but is prevented from being seated in the connector cavity over the second terminal position assurance.

10. The connector housing assembly as set forth in claim 9 wherein the aperture is further defined by a pair of corners which are configured to interfere with the pair of first walls of the terminal position assurance when the male blade stabilizer is installed incorrectly.

11. The connector housing assembly as set forth in claim 9, wherein the connector housing further includes a plurality of protrusions on the bottom of the connector cavity and the male blade stabilizer including a plurality of depressions on the bottom surface, wherein each of the plurality of protrusions bounds a respective terminal cavity and each of the plurality of depressions bounds a respective terminal slot, and wherein the plurality of depressions are configured to receive the plurality of protrusions.

12. The connector housing assembly as set forth in claim 11, wherein each of the plurality of protrusions are shaped as a truncated pyramid and each of the plurality of depressions are a corresponding inverse truncated pyramid.

13. A connector housing assembly as set forth in claim 9, wherein the connector housing further includes a nub, a guide beam, and a guide rib, where the guide beam and the guide rib are spaced apart from each other so as to define a slot; and the electrical connector further including a depression and an elongated member, wherein the depression is configured to receive the nub and the elongated member slidingly engages the slot when the electrical connector is in the connector housing so as to retain the electrical connector in a predetermined position and secure an electrical connection.

14. The connector housing assembly as set forth in claim 13, wherein the connector housing includes four each of the guide beams and guide ribs and the electrical connector includes four corresponding elongated members.

15. The connector housing assembly as set forth in claim 14, the connector housing further including a bridge disposed on an outer surface of the front wall and the back wall that increases a rigidity of the front wall and the back wall.

16. The connector housing assembly as set forth in claim 15, wherein the front wall and the back wall each include an upper lip that increases in thickness as it approaches the bridge.

* * * * *